US011371476B2

(12) United States Patent
Kim et al.

(10) Patent No.: US 11,371,476 B2
(45) Date of Patent: Jun. 28, 2022

(54) POSITIVE CRANKCASE VENTILATION OUTLET ANTI-FREEZING DEVICE OF INTAKE MANIFOLD OF VEHICLE ENGINE

(71) Applicant: HYUNDAI KEFICO CORPORATION, Gunpo-si (KR)

(72) Inventors: Min Ki Kim, Gyeonggi-do (KR); Hyung Wook Kim, Gyeonggi-do (KR); Chan Karam Na, Gyeonggi-do (KR)

(73) Assignee: Hyundai Kefico Corporation, Gyeonggi-do (KR)

( * ) Notice: Subject to any disclaimer, the term of this patent is extended or adjusted under 35 U.S.C. 154(b) by 0 days.

(21) Appl. No.: 16/980,606

(22) PCT Filed: Jun. 11, 2019

(86) PCT No.: PCT/KR2019/006968
§ 371 (c)(1),
(2) Date: Sep. 14, 2020

(87) PCT Pub. No.: WO2019/240451
PCT Pub. Date: Dec. 19, 2019

(65) Prior Publication Data

US 2021/0246854 A1 Aug. 12, 2021

(30) Foreign Application Priority Data

Jun. 11, 2018 (KR) ..... 10-2018-0067016

(51) Int. Cl.
*F02M 35/10* (2006.01)
*F01M 13/00* (2006.01)
(Continued)

(52) U.S. Cl.
CPC .. *F02M 35/10222* (2013.01); *F01M 13/0011* (2013.01); *F01M 2013/0027* (2013.01); *F01M 2013/0455* (2013.01); *F02M 35/104* (2013.01)

(58) Field of Classification Search
CPC ..... F02M 35/10222; F02M 35/104; F01M 13/0011; F01M 2013/0027; F01M 2013/0455
See application file for complete search history.

(56) References Cited

U.S. PATENT DOCUMENTS 6,058,917 A 5/2000 Knowles
2010/0269804 A1* 10/2010 Miyaji ..... F02M 35/10124 123/572

FOREIGN PATENT DOCUMENTS

JP 4498651 B2 7/2010
KR 101189572 B1 10/2012
(Continued)

OTHER PUBLICATIONS

International Search Report dated Aug. 26, 2019 in corresponding PCT Application Serial No. PCT/KR2019/006968.

*Primary Examiner* — Jacob M Amick
(74) *Attorney, Agent, or Firm* — Fox Rothschild LLP

(57) ABSTRACT

A positive crankcase ventilation (PCV) outlet anti-freezing device of an intake manifold of a vehicle engine includes a first guide and a second guide formed adjacent to a PCV outlet within an inlet tube of the intake manifold to block direct contact between fresh air and a PCV gas, thereby preventing condensation and freezing of the PCV gas. The first guide and the second guide also can improve flow distribution of the intake manifold by improving fluidity of the fresh air.

7 Claims, 10 Drawing Sheets

(51) Int. Cl.
*F01M 13/04* (2006.01)
*F02M 35/104* (2006.01)

(56) References Cited

FOREIGN PATENT DOCUMENTS

| | | | |
|---|---|---|---|
| KR | 101234649 | B1 | 2/2013 |
| KR | 101423782 | B1 | 7/2014 |
| KR | 101704239 | B1 | 2/2017 |
| KR | 20180009124 | A | 1/2018 |

* cited by examiner

POSITIVE CRANKCASE VENTILATION OUTLET ANTI-FREEZING DEVICE OF INTAKE MANIFOLD OF VEHICLE ENGINE

CROSS-REFERENCE TO RELATED APPLICATIONS

This application is a National Phase application filed under 35 USC 371 of PCT International Application PCT/KR2019/006968 with an International Filing Date of Jun. 11, 2019, which claims priority from Korean Application 10-2018-0067016 filed on Jun. 11, 2018. The entire contents of these applications are incorporated herein by reference in their entirety.

BACKGROUND

(a) Technical Field

The present disclosure relates to a positive crankcase ventilation (PCV) outlet anti-freezing device of an intake manifold of a vehicle engine, more particularly, to the PCV outlet anti-freezing device that may prevent a PCV gas from directly contacting cold air, introduced from the outside, at a PCV outlet, thereby preventing the PCV outlet from being frozen.

(b) Description of the Related Art

In a vehicle engine, there is a gap between a piston and a cylinder wall, and a blow-by gas flows from a combustion chamber into a crankcase through the gap. The blow-by gas is mostly unburned fuel and also may contain combustion gases, partially oxidized mixed gases, and a small amount of engine oil.

If the blow-by gas remains in the crankcase, the blow-by gas can cause corrosion to be generated inside the engine and degrade engine oil performance. Thus, the blow-by gas must be removed from the crankcase. Since any blow-by gas discharged to the atmosphere causes air pollution, the blow-by gas is circulated to the combustion chamber through an intake system to be re-combusted.

Such a blow-by gas recirculation device is referred to as a positive crankcase ventilation (PCV) system.

Korean Patent No. 10-1189572 (Oct. 11, 2012) and Korean Patent No. 10-1234649 (Feb. 19, 2013) each disclose a blow-by gas passage structure.

The PCV system includes a reflux passage for inducing a blow-by gas from a crankcase to an upper space of a cylinder head through a cylinder block, and a PCV hose which connects a cylinder head cover with a predetermined location of an inlet tube of an intake manifold.

Accordingly, the blow-by gas is recirculated to and combusted in a combustion chamber through the intake manifold from the crankcase, and is then discharged after purification through the exhaust system, thereby ventilating the crankcase and preventing air pollution that would result from discharging the blow-by gas.

FIG. 1 (RELATED ART) is a cutout perspective diagram of an inlet tube 2 part of an intake manifold 1, and a predetermined location on an inner circumferential surface of the inlet tube 2 is formed with a PCV outlet 3 from which a blow-by gas (referred to as PCV gas, crankcase emission, and the like) is discharged.

The PCV gas discharged from the PCV outlet 3 is mostly in a gas form or partially in a liquid form, and various pieces of sludge, condensate, and the like, generated inside the engine, in addition to the PCV gas, are discharged through the PCV outlet 3.

Meanwhile, at a cold start-up during winter, since air introduced through the inlet tube 2 of the intake manifold 1 is cold, and the PCV gas recirculated from the crankcase is relatively warm, the condensation and freezing phenomenon occurs when the PCV gas contacts the outside air. There is a problem in that when the engine operation continues, the amount of freezing is increased and thus the PCV outlet 3 may be clogged, such that the crankcase is not normally ventilated and in a severe case, the intake manifold 1 is damaged.

Conventionally, in order to prevent the freezing phenomenon described above, additional devices such as a heat transfer coil type heater and a large-diameter hose have been used, and in such a case, there is a problem in that the manufacturing costs related to the PCV system are increased.

SUMMARY

Accordingly, an object of the present disclosure is to provide a PCV outlet anti-freezing device of an intake manifold, which may prevent the freezing of a PCV outlet caused by contact between a PCV gas and cold fresh air (i.e., air sucked in from the outside) at a cold start-up (e.g., during winter) without using a separate additional device.

In addition, another object of the present disclosure is to provide a PCV outlet anti-freezing device of an intake manifold, which may easily discharge liquid components through a PCV outlet, thereby improving recirculation performance of a PCV system, improve the flow of the fresh air around the PCV outlet, thereby improving the flow distributivity of an intake manifold, and prevent the contamination and malfunction of a map sensor caused by the PCV gas.

According to the present disclosure a PCV outlet anti-freezing device of an intake manifold is provided in the intake manifold, and prevents a PCV outlet, formed on the inner circumferential surface of an inlet tube into which fresh air flows, from being frozen, the PCV outlet anti-freezing device including a first guide which allows the flow of the introduced fresh air to be away from the PCV outlet at a location which is spaced apart from the PCV outlet formed on the inner circumferential surface of the inlet tube to an inlet end side of the inlet tube.

The first guide may include an inclined portion which protrudes obliquely upward from the inner circumferential surface of the inlet tube, and a support wall portion which extends in the direction toward the inner circumferential surface of the inlet tube from the upper end portion of the inclined portion to support the inclined portion.

In addition, the PCV outlet anti-freezing device may further include a second guide which is formed on one side portion of the rim of the PCV outlet and blocks the direct contact between a part of the fresh air passing through the first guide and the PCV gas discharged from the PCV outlet.

The second guide may include a support wall portion which protrudes in an arc shape from the first guide side portion on the rim portion of the PCV outlet, and a blocking plate portion which is formed integrally above the support wall portion to be formed at a location facing the PCV outlet.

Since a height (h1) of the first guide is greater than a height (h2) of the second guide (h1>h2), and a width (w1) of the first guide is greater than a width (w2) of the second guide (w1>w2), the second guide may be hidden by the first guide, when the first guide and the second guide are viewed from the inlet side of the inlet tube.

A liquid discharge groove which obliquely connects the inner circumferential surface of the PCV outlet with the inner circumferential surface of the inlet tube may be formed below the PCV outlet.

The liquid discharge groove may be formed in a triangular shape which has a wide upper portion and a narrow lower end.

A mounting hole may be formed by penetrating the inlet tube, the mounting hole may be formed to be spaced apart from the location facing the PCV outlet, and the second guide may be formed between the PCV outlet and the mounting hole to prevent the PCV gas from being discharged toward a sensitive portion of a map sensor.

According to the present disclosure described above, by blocking the direct contact between the PCV gas and the fresh air by the first guide and the second guide which are integrally formed in the intake manifold, it is possible to prevent the PCV outlet from being frozen, thereby smoothly recirculating the PCV gas and preventing the intake manifold from being damaged.

In addition, by discharging the sludge and the liquid components on the PCV passage more smoothly by forming the liquid discharge groove below the PCV outlet, it is also possible to discharge the gas components of the PCV gas more actively, thereby entirely improving the recirculation performance of the PCV gas.

In addition, by stabilizing the air flow around the PCV outlet by the first guide, it is possible to improve the flow distributivity of the intake manifold.

In addition, the contamination and malfunction of the map sensor caused by the PCV gas discharged from the PCV outlet are prevented by the second guide.

In addition, since the PCV outlet is prevented from being frozen as described above, the additional device, such as a heater coil or a large-diameter hose, is not used, which has been conventionally used to prevent the PCV outlet from being frozen, thereby reducing the manufacturing costs related to the PCV system.

DESCRIPTION OF SPECIFIC EMBODIMENTS

Figure 1:
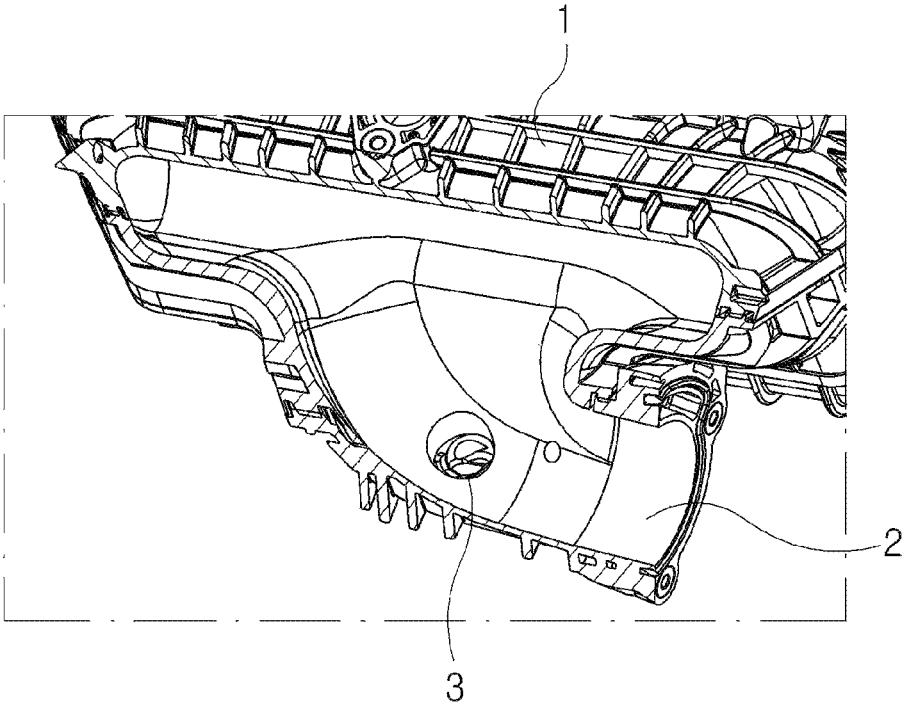
FIG. 1 (RELATED ART)
FIG. 1 (RELATED ART) is a partially cutout perspective diagram of an inlet tube of an intake manifold according to the related art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Since various changes and numerous embodiments may be made in the present disclosure, particular embodiments will be illustrated in the drawings and described in detail. However, it should be understood that the present disclosure is not intended to be limited to specific embodiments, but includes all changes, equivalents, and substitutes included in the spirit and technical scope of the present disclosure. The thicknesses of the lines or the sizes of the components illustrated in the accompanying drawings may be exaggeratedly illustrated for clarity and convenience of description.

In addition, terms to be described later are terms defined in consideration of functions in the present disclosure, which may vary depending on the intention of a user or an operator or precedents. Accordingly, definitions of these terms should be made based on the contents throughout the present specification.

Hereinafter, preferred embodiments according to the present disclosure will be described in detail with reference to the accompanying drawings.

Figure 2:
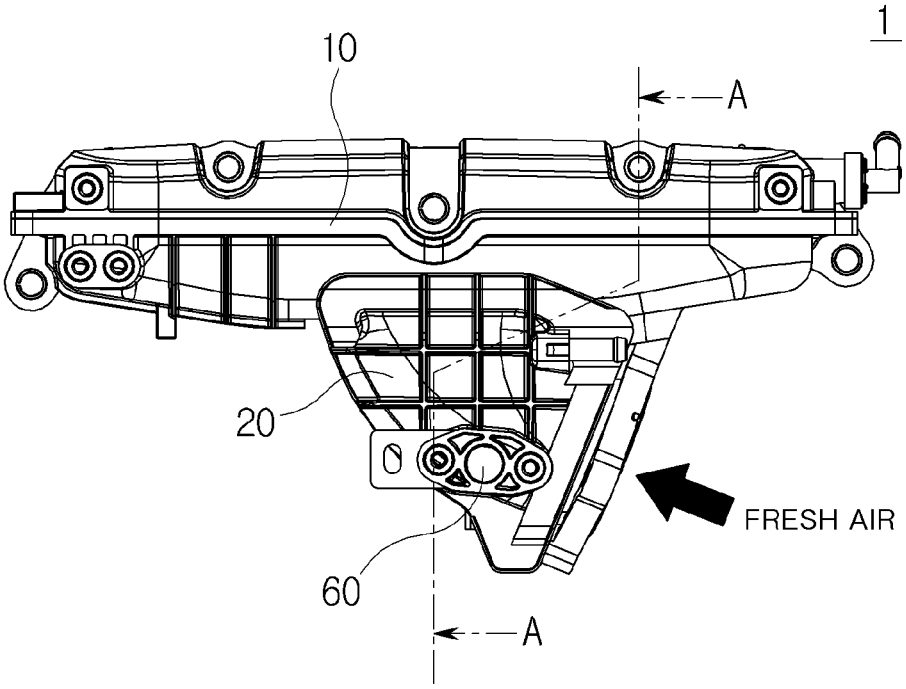
FIG. 2 is a plan diagram of an intake manifold to which a PCV outlet anti-freezing device according to the present disclosure is applied.
Figure 3:
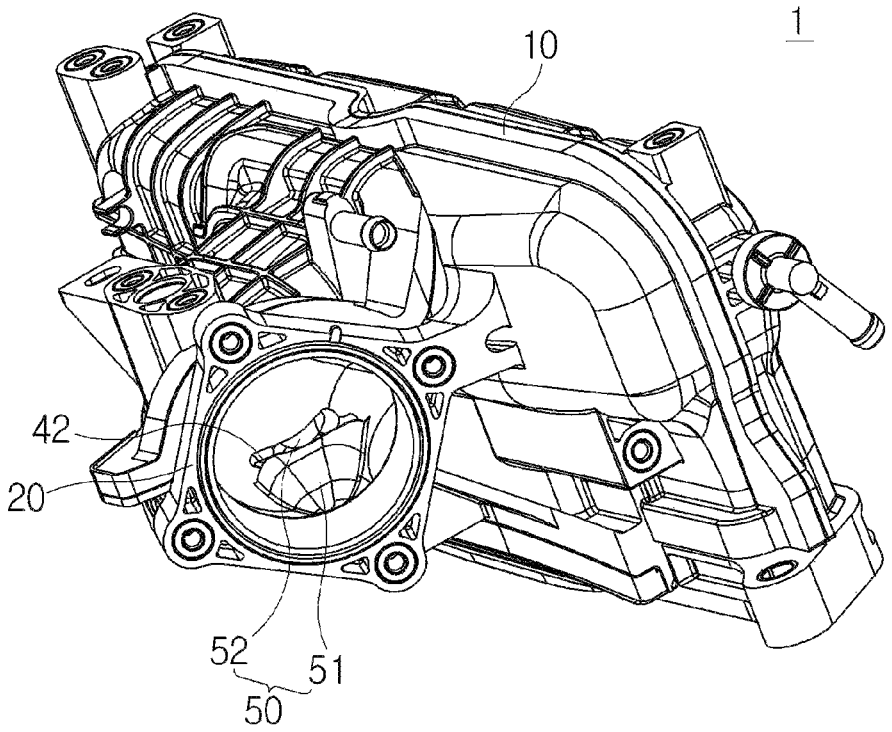
FIG. 3 is a perspective diagram of the intake manifold in a state where the interior of an inlet tube is viewed.
Figure 4:
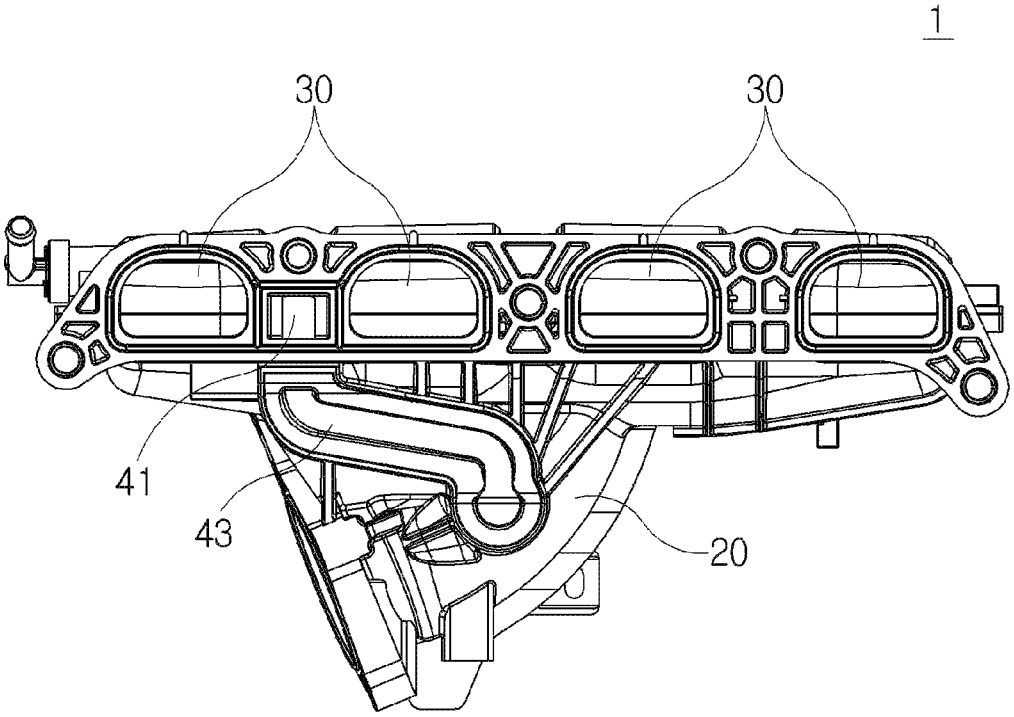
FIG. 4 is a rear diagram of FIG. 2.

As illustrated in FIGS. 2 to 4, an intake manifold 1 of an engine has a structure in which an inlet tube 20, into which fresh air flows, is formed at one side of a surge tank 10, and an intake outlet end 30 coupled to an inlet port of a cylinder head is formed at the other side the surge tank 10. The number of intake outlet ends 30 is equal to the number of combustion chambers (cylinders) of the engine.

At this time, since the components, which are not described specifically in the present disclosure among the components of the intake manifold 1, have the same structure and effects as the conventional intake manifold 1 illustrated in FIG. 1, a detailed description thereof will be omitted.

The fresh air is supplied to the combustion chamber of the engine via the inlet tube 20, the surge tank 10, and the intake outlet end 30 sequentially.

Although not illustrated, a mounting flange formed on the end portion of the inlet tube 20 may be mounted with a throttle body having a throttle valve to adjust the amount of fresh air introduced.

Figure 5:
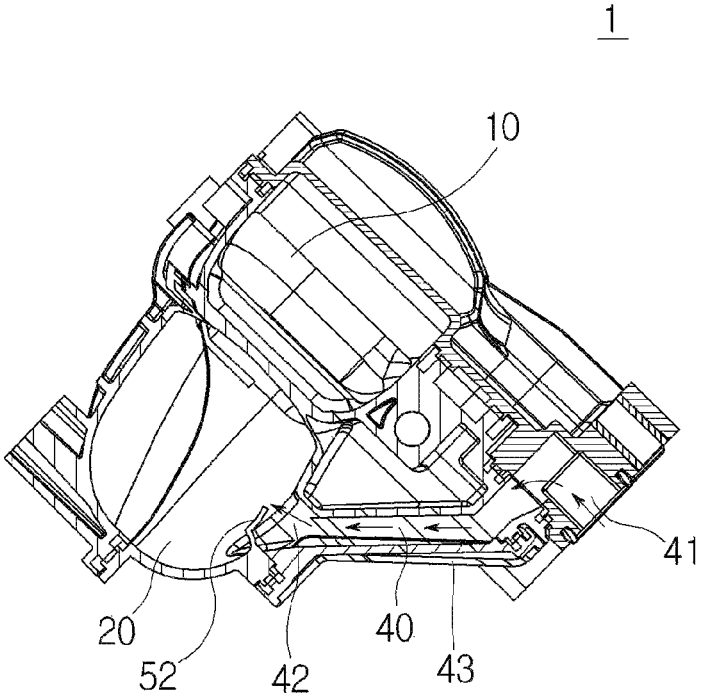
FIG. 5 is a cross-sectional diagram taken along the line A-A illustrated in FIG. 2.

As illustrated in FIGS. 4 and 5, one side portion (rear bottom surface in FIG. 2) of the intake manifold 1 is formed with a PCV passage 40 which connects a PCV inlet 41 formed between the intake outlet ends 30 and a PCV outlet 42 which is opened into the inlet tube 20.

The PCV passage 40 is a groove which is concavely formed in the surface of the intake manifold 1, and a PCV cover 43 is mounted to block the groove from the outside, thereby forming the PCV passage 40 which is sealed against the outside. The PCV gas in a crankcase rises through a reflux passage of a cylinder block to be introduced through the PCV inlet 41 of the intake manifold 1 which is connected to the cylinder head, and the PCV gas is discharged into the inlet tube 20 of the intake manifold through the PCV outlet 42 via the PCV passage 40. Thereafter, the PCV gas is mixed with the fresh air flowing into the inlet tube 20 and is re-supplied to the engine combustion chamber through each runner after the surge tank 10.

As illustrated in FIGS. 3 and 6-8, a PCV outlet anti-freezing device 50 is formed inside the inlet tube 20 of the intake manifold adjacent to the PCV outlet 42, and the PCV outlet anti-freezing device 50 includes a first guide 51 and a second guide 52.

The first guide 51 is formed to be spaced at a predetermined distance apart from the PCV outlet 42, and the second guide 52 is formed in contact with the end portion (rim portion) of the PCV outlet 42. That is, the first guide 51 and the second guide 52 are formed in this order along the flow direction of the fresh air (the first guide 51 is close to the end portion of the inlet tube 20, and the second guide 52 is far from the end portion of the inlet tube 20).

The first guide 51 and the second guide 52 are integrally formed in the inlet tube 20 of the intake manifold. That is, when a portion including the inlet tube 20 of the intake manifold (since the intake manifold is configured to be divided into a plurality of portions, the intake manifold is here referred to as a portion including the inlet tube 20) is injection-molded, the PCV outlet 42, and the first guide 51 and the second guide 52 are formed all together.

The first guide 51 includes an inclined portion 51*a* which protrudes obliquely upward from the inner circumferential surface of the inlet tube 20, and a support wall portion 51*b* which extends in the direction toward the inner circumferential surface of the inlet tube 20 from the upper end portion of the inclined portion 51*a* to support the inclined portion 51*a*. When the inlet tube 20 is viewed from the front (the state illustrated in FIG. 6), the inclined portion 51*a* is formed so that the middle portion thereof is high, and both side portions thereof extend to be smoothly inclined downward to be connected to the inner circumferential surface of the inlet tube 20. At this time, the inner circumferential surface of the inlet tube 20 to which the support wall portion 51*b* is connected is coupled to the PCV cover 43.

The second guide 52 includes a support wall portion 52*a* having an arc shape (illustrated in a substantially semicircular shape in FIG. 6) which protrudes in the form of surrounding one side rim portion of the PCV outlet 42, and a blocking plate portion 52*b* which is formed integrally above the support wall portion 52*a*, and formed to face the PCV outlet 42 to block a part of the opened area of the PCV outlet 42.

The support wall portion 52*a* is formed at the inlet portion of the inlet tube 20, that is, a side portion into which the fresh air flows in the rim portion of the PCV outlet 42.

The support wall portion 51*b* of the first guide 51 and the support wall portion 52*a* of the second guide 52 are spaced at a predetermined distance apart from each other and a gap exists therebetween.

Figure 6:
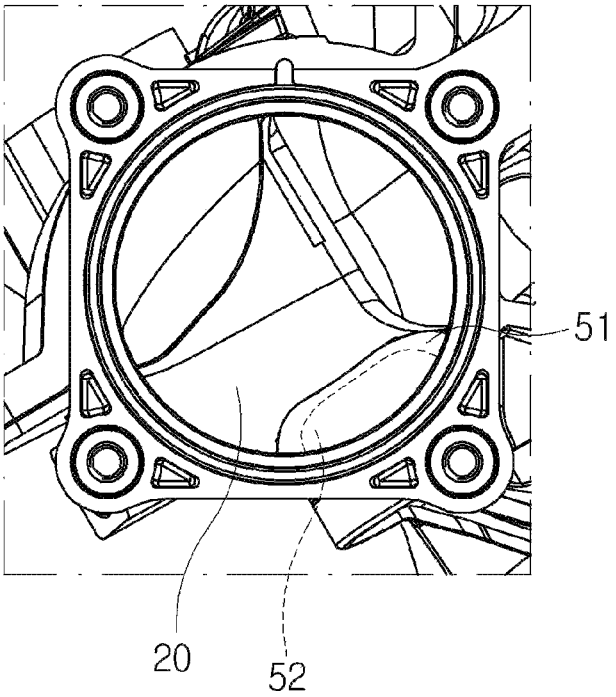
FIG. 6 is a front enlarged diagram of the inlet tube.
Figure 7:
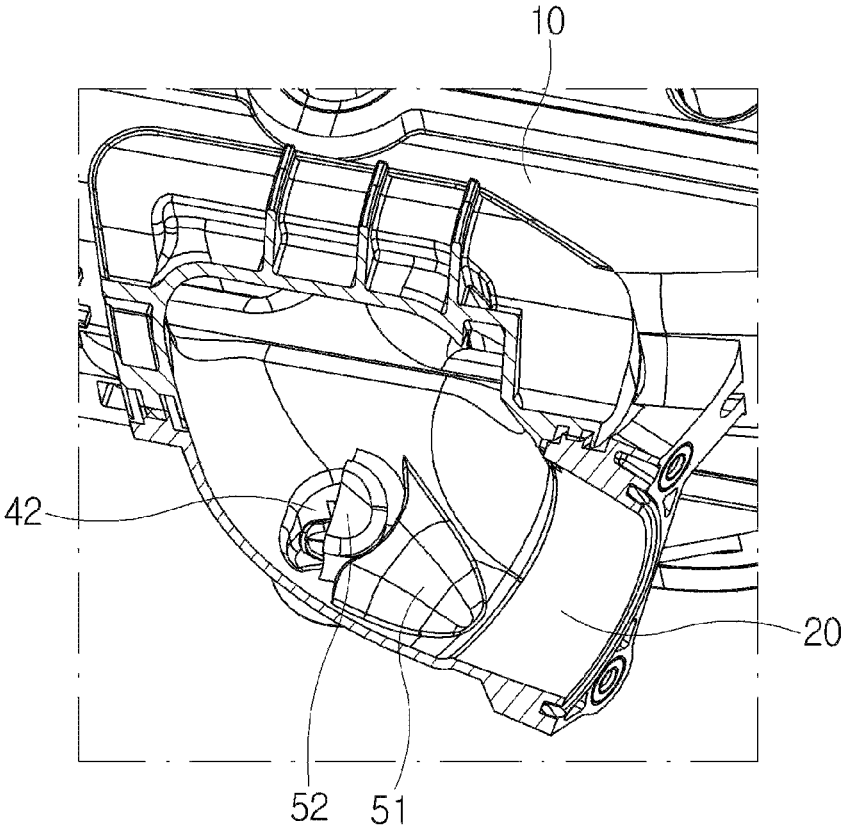
FIG. 7 is an enlarged cutout perspective diagram of the inlet tube.
Figure 8:
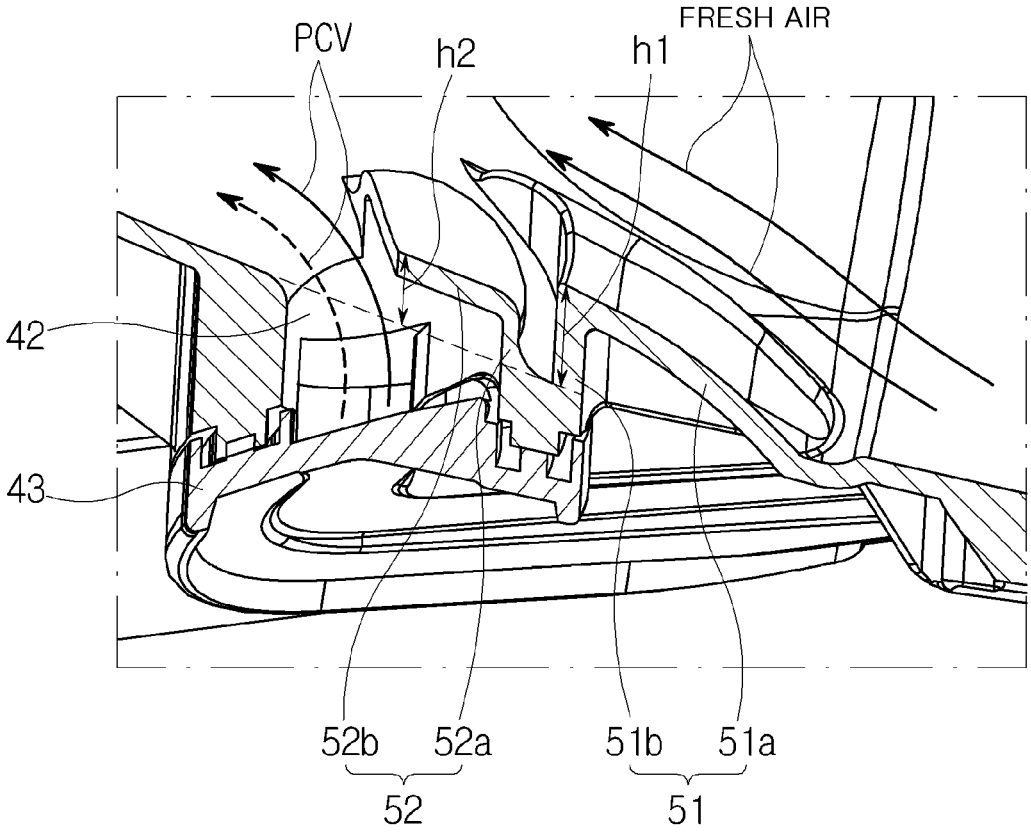
FIG. 8 is a longitudinal cross-sectional diagram of a first guide and a second guide which are primary components of the present disclosure.

As can be seen in FIGS. 6 and 8, since a height (h1) of the first guide 51 is greater than a height (h2) of the second guide 52 (where the height means the amount of radially protruding inward from the inner circumferential surface of the inlet tube 20), the second guide 52 is hidden by the first guide 51 (h1>h2), when viewed from the inlet of the inlet tube 20 (see FIG. 6).

Figure 9:
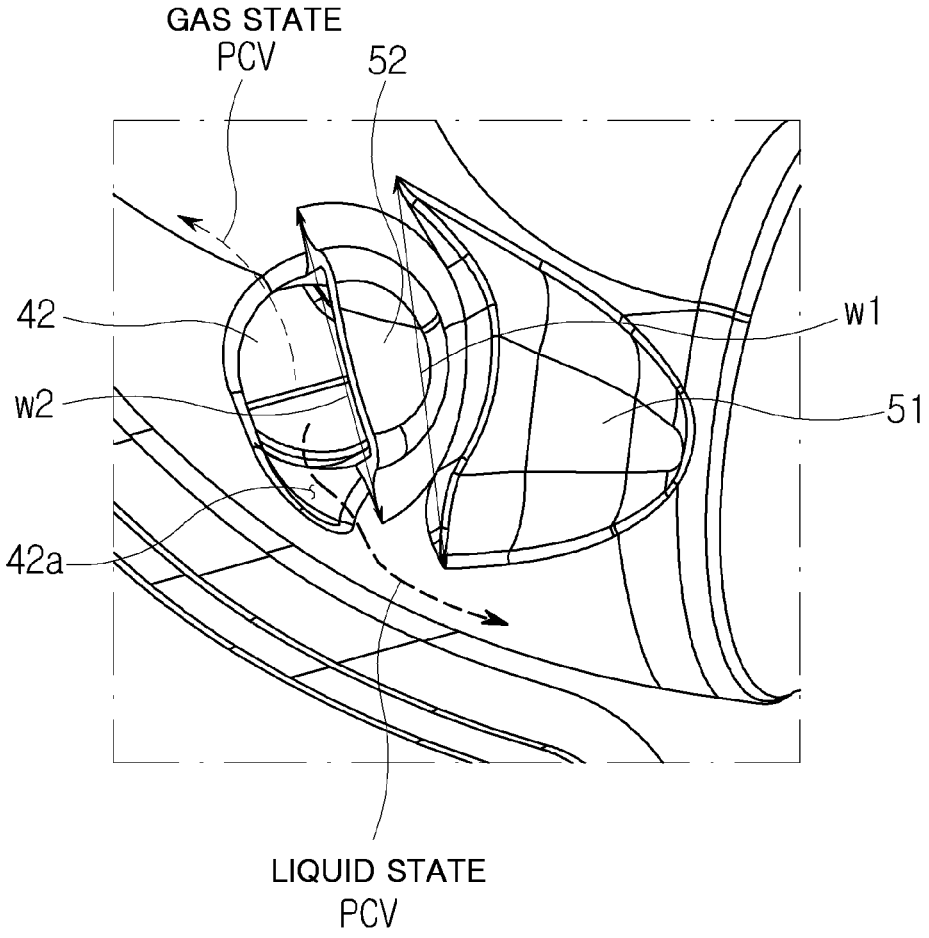
FIG. 9 is an enlarged diagram of a PCV outlet.

In addition, as can be confirmed in FIG. 9, since a width (w1) of the first guide 51 is greater than a width (w2) of the second guide 52 (w1>w2) even in both widths thereof, the second guide 52 is hidden by the first guide 51, when viewed from the inlet of the second guide 52.

Meanwhile, as illustrated in FIG. 9, a liquid discharge groove 42*a* is formed radially outward from the PCV outlet 42 in the lower partial section of the rim portion of the PCV outlet 42, that is, in a gravity direction in a state where the intake manifold 1 is mounted to the cylinder head of the engine.

The liquid discharge groove 42*a* is formed in a substantially triangular shape which has a wide upper portion connected to the rim portion of the PCV outlet 42, and a narrow lower end, and a surface connecting the lower end and the upper portion is formed as an inclined surface which obliquely connects the inner circumferential surface of the inlet tube 20 and the inner circumferential surface of the PCV outlet 42.

Figure 10:
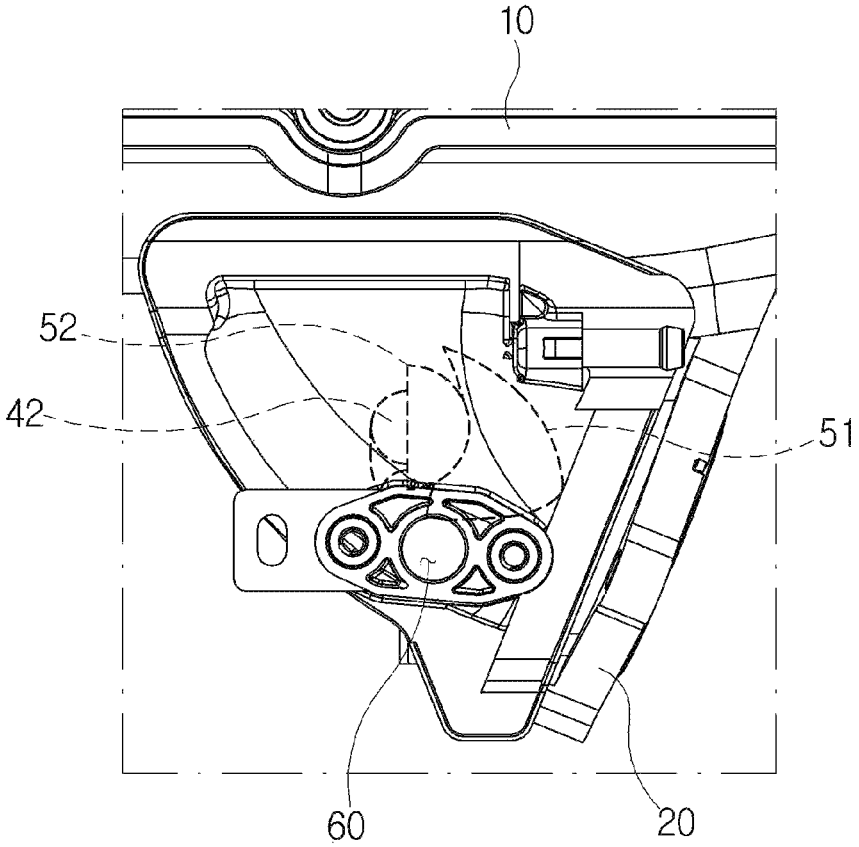
FIG. 10 is a partially enlarged diagram of FIG. 2, which is a diagram for explaining the relative location between the PCV outlet and a mounting hole.

Meanwhile, as illustrated in FIG. 10, the outer one side portion of the inlet tube 20 is formed with a mounting hole 60 in which a map sensor which is one component of an Engine Management System (EMS) is mounted. A sensitive portion of the map sensor is inserted into the inlet tube 20 through the mounting hole 60 to measure the flow rate of the fresh air passing through the inlet tube 20, that is, the intake flow rate based on the pressure inside the inlet tube 20.

As described above, the mounting hole 60 into which the map sensor is inserted and installed is formed at a location which is spaced apart from the location facing the PCV outlet 42.

Now, the operations and effects of the PCV outlet anti-freezing device of the intake manifold according to the present disclosure will be described.

As illustrated in FIG. 8, the fresh air introduced from the inlet side of the inlet tube 20 rises along the inclined portion 51*a* of the first guide 51 to move in a direction far from the PCV outlet 42. Accordingly, the warm PCV gas discharged from the PCV outlet 42 and the cold fresh air do not directly contact each other, thereby reducing the phenomenon in which the PCV gas is condensed and frozen.

Meanwhile, a part of the fresh air which goes downward immediately after passing the inclined portion 51*a* of the first guide 51 directly contacts the PCV gas discharged from the PCV outlet 42, which is prevented by the second guide 52. That is, since the support wall portion 52*a* and the blocking plate portion 52*b* of the second guide 52 block the half of the first guide 51 side of the PCV outlet 42, the PCV gas is discharged through the opened half portion which is far from the first guide 51, thereby preventing the condensation and freezing phenomenon due to the direct contact between a part of the fresh air, falling from the upper end of the inclined portion 51*a* of the first guide 51, and the PCV gas.

Such anti-freezing performance may be further doubled by reducing the tendency in which the fresh air passing the first guide 51 approaches the second guide 52 side due to the height of the upper end of the inclined portion 51*a* of the first guide 51 greater than the height of the blocking plate portion 52*b* of the second guide 52.

In addition, since the widthwise length of the first guide 51 is greater than the widthwise length of the second guide 52, the first guide 51 spreads the flow of the fresh air from side to side to prevent the fresh air from directly passing through the PCV outlet 42, and accordingly, the direct contact between the fresh air and the PCV gas is blocked, thereby improving the anti-freezing performance.

In addition, the first guide 51 and the second guide 52 are repeatedly disposed with being spaced at a predetermined distance apart from each other along the moving direction of the fresh air, thereby improving the performance of blocking the direct contact between the fresh air and the PCV gas to further improve the anti-freezing performance.

As described above, since no freezing occurs around the PCV outlet 42, the area of the PCV outlet 42 is not reduced to smoothly discharge the PCV gas, thereby improving the recirculation performance of the PCV gas.

In addition, it is possible to prevent the clogging phenomenon of the PCV outlet 42 and damage to the intake manifold, caused by the expansion of the freezing area.

Meanwhile, not only the PCV gas in a gas form but also the PCV gas in a liquid form are discharged through the PCV outlet 42, and various pieces of sludge and condensate generated in the engine are discharged together.

The liquid mixed with the PCV gas, the sludge, and the condensate described above may flow through the PCV passage 40 and reach the PCV outlet 42 to meet the liquid discharge groove 42*a* (see FIG. 9) at the lower side in the gravity direction and then flow downward, thereby being discharged through the PCV outlet 42 more smoothly. As describe above, the liquid component is smoothly discharged from the PCV passage 40, thereby also discharging the PCV gas more smoothly.

The discharged liquid is moved toward the surge tank 10 along the inner circumferential surface of the inlet tube 20 by the high-speed flow of the fresh air flowing into the inlet tube 20, and vaporized and mixed with the fresh air during the movement, to be resupplied to the combustion chamber. Overall, such an operation also helps to improve the recirculation performance of the PCV gas.

Meanwhile, when there are no first guide 51 and second guide 52, that is, when only the PCV outlet 42 is formed on the inner circumferential surface of the inlet tube 20 of the intake manifold, the flow of the fresh air is disturbed by the shape of the PCV outlet 42 itself and the flow of the PCV gas discharged from the PCV outlet 42, such that the flow performance of the fresh air is degraded to impair the flow distributivity to each intake outlet end 30.

However, the first guide 51 and the second guide 52 which are formed according to the present disclosure may allow the flow of the fresh air to be away from the PCV outlet 42 and block the direct contact with the PCV gas discharged from the PCV outlet 42, thereby preventing the disturbance between the fresh air and the PCV gas. Accordingly, the flow of the fresh air is stabilized by the first guide 51 and the second guide 52, thereby improving the flow distributivity of the fresh air. The fresh air is evenly distributed to each combustion chamber of the engine by improving the flow distributivity, thereby improving the output balance between the respective combustion chambers to improve the stability of the engine operation.

In Table 1 below, the improvement in the flow distributivity according to the present disclosure may be confirmed.

TABLE 1

| Items Intake | Related art | | | | | Technology of present disclosure | | | | |
|---|---|---|---|---|---|---|---|---|---|---|
| outlet end | NO.1 | NO.2 | NO.3 | NO.4 | Average | NO.1 | NO.2 | NO.3 | NO.4 | Average |
| Mass flow (kg/h) | 274.8 | 273.2 | 275.6 | 278.3 | 275.5 | 273.3 | 270.8 | 272.7 | 274.9 | 272.9 |
| Cf | 0.80 | 0.80 | 0.80 | 0.81 | 0.80 | 0.80 | 0.79 | 0.80 | 0.80 | 0.80 |
| Deviation (%) | — 0.26 | — 0.81 | 0.05 | 1.02 | Max (absolute value) 1.02% | 0.13 | — 0.75 | — 0.11 | 0.74 | Max (absolute value) 0.75% |

Referring to Table 1, it may be seen that the flow distributivity was improved from 1.02% in the related art to 0.75% in the present disclosure (the flow distributivity is determined by the maximum absolute value and is improved as the numerical value thereof is smaller). Meanwhile, as illustrated in FIG. 10, the mounting hole 60 in which the map sensor is installed is formed at a location which gets out of a location facing the PCV outlet 42, and the second guide 52 including the support wall portion 52*a* and the blocking plate portion 52*b* is formed on one side portion of the rim of the PCV outlet 42.

Since the sensitive portion of the map sensor which is inserted into the mounting hole 60 is spaced apart from the location facing the PCV outlet 42, that is, the location where the PCV gas is discharged to contact, and the second guide 52 is formed between the PCV outlet 42 and the map sensor, the PCV gas discharged from the PCV outlet 42 is blocked from contacting the sensitive portion of the map sensor.

Accordingly, the sensitive portion of the map sensor is prevented from being contaminated due to the foreign matters which are contained in the PCV gas and attached to the sensitive portion of the map sensor, so that the map sensor may always deliver accurate measured values to the EMS, thereby improving the engine control performance.

In addition, since the present disclosure prevents the PCV outlet from being frozen by the first guide 51 and the second guide 52 which are integrally formed on the inner circumferential surface of the inlet tube 20 of the intake manifold as described above, the present disclosure does not require the use of the additional device, such as a separate heater or a large-diameter hose, unlike the conventional technology, thereby reducing the manufacturing costs related to the PCV system.

As described above, while the present disclosure has been described with reference to the embodiments illustrated in the drawings, the embodiments are merely illustrative, and those skilled in the art to which the present disclosure pertains will understand that various modifications and equivalent other embodiments may be made therefrom. Accordingly, the true technical protection scope of the present disclosure will be defined by the following claims.

What is claimed is:

1. A positive crankcase ventilation (PCV) outlet anti-freezing device of an intake manifold of a vehicle engine, the PCV outlet anti-freezing device comprising:

the intake manifold including an inlet tube into which fresh air flows and a PCV outlet formed on an inner circumferential surface of the inlet tube, the PCV outlet anti-freezing device provided in the intake manifold, and configured to prevent the PCV outlet from being frozen, a first guide that allows the fresh air to flow away from the PCV outlet at a location spaced apart from the PCV outlet formed on the inner circumferential surface of the inlet tube to an inlet end side of the inlet tube, and a second guide which is formed on one side portion of a rim of the PCV outlet and blocks direct contact between a part of the fresh air passing through the first guide and the PCV gas discharged from the PCV outlet.

2. The PCV outlet anti-freezing device of claim 1, wherein the first guide comprises:

an inclined portion which protrudes obliquely upward from the inner circumferential surface of the inlet tube; and a support wall portion which extends in a direction toward the inner circumferential surface of the inlet tube from an upper end portion of the inclined portion to support the inclined portion.

3. The PCV outlet anti-freezing device of claim 1, wherein the second guide comprises:

a support wall portion which protrudes in an arc shape from a first guide side portion at the rim portion of the PCV outlet; and a blocking plate portion which is formed integrally above the support wall portion to be formed at a location facing the PCV outlet.

4. The PCV outlet anti-freezing device of claim 1, wherein since a height (h1) of the first guide is greater than a height (h2) of the second guide (h1>h2), and a width (w1) of the first guide is greater than a width (w2) of the second guide (w1>w2), the second guide is hidden by the first guide, when the first guide and the second guide are viewed from the inlet side of the inlet tube.

5. A positive crankcase ventilation (PCV) outlet anti-freezing device of an intake manifold of a vehicle engine, the PCV outlet anti-freezing device comprising:

the intake manifold including an inlet tube into which fresh air flows and a PCV outlet formed on an inner circumferential surface of the inlet tube, the PCV outlet anti-freezing device provided in the intake manifold, and configured to prevent the PCV outlet from being frozen, and a first guide that allows the fresh air to flow away from the PCV outlet at a location spaced apart from the PCV outlet formed on the inner circumferential surface of the inlet tube to an inlet end side of the inlet tube, wherein a liquid discharge groove which obliquely connects an inner circumferential surface of the PCV outlet with the inner circumferential surface of the inlet tube is formed below the PCV outlet.

6. The PCV outlet anti-freezing device of claim 5, wherein the liquid discharge groove is formed in a triangular shape which has a wide upper portion and a narrow lower end.

7. The PCV outlet anti-freezing device of claim 3, wherein a mounting hole is formed by penetrating the inlet tube, the mounting hole being spaced apart from the location facing the PCV outlet, and the second guide is formed between the PCV outlet and the mounting hole.

* * * * *